United States Patent [19]

Ohtake et al.

[11] Patent Number: 4,689,114

[45] Date of Patent: Aug. 25, 1987

[54] METHOD FOR MANUFACTURING A SHADOW MASK

[75] Inventors: Yasuhisa Ohtake; Makoto Harigae, both of Fukaya, Japan

[73] Assignee: Kabushiki Kaisha Toshiba, Kawasaki, Japan

[21] Appl. No.: 652,092

[22] Filed: Sep. 19, 1984

[30] Foreign Application Priority Data

Sep. 26, 1983 [JP] Japan ..... 58-176378

[51] Int. Cl.[4] ..... C23F 1/02; B44C 1/22

[52] U.S. Cl. ..... 156/644; 156/345; 156/640; 156/656; 156/661.1; 156/664; 430/312; 430/313; 430/318

[58] Field of Search ..... 156/664, 640, 656, 644, 156/659.1, 661.1, 345; 430/312, 313, 318, 5, 6, 7, 23; 313/402, 403

[56] References Cited

U.S. PATENT DOCUMENTS

| | | | |
|---|---|---|---|
| 3,971,682 | 7/1976 | Frantzen | 156/644 |
| 4,013,498 | 3/1977 | Frantzen et al. | 156/345 |
| 4,124,437 | 11/1978 | Bond et al. | 156/644 X |

FOREIGN PATENT DOCUMENTS

| | | | |
|---|---|---|---|
| 0037551 | 10/1981 | European Pat. Off. . | |
| 0042496 | 12/1981 | European Pat. Off. . | |
| 2046417 | 3/1971 | France . | |
| 2278150 | 2/1976 | France . | |
| 57-26345 | 6/1982 | Japan . | |
| 59-73833 | 4/1984 | Japan | 156/644 |
| 59-81839 | 5/1984 | Japan | 156/644 |

*Primary Examiner*—Donald E. Czaja
*Assistant Examiner*—Ramon R. Hoch
*Attorney, Agent, or Firm*—Cushman, Darby & Cushman

[57] ABSTRACT

In a method for manufacturing a shadow mask, the both surfaces of a metal sheet, except those regions in which small and large openings are to be formed, are coated with resist films. The upper surface of the metal sheet is further coated with an organic synthetic film. An etching solution is sprayed on the lower surface of the metal sheet, kept in a substantially horizontal position, to etch the region corresponding to the small opening, thereby forming small recesses. Thereafter, the resist film on the lower surface is removed. Then, the metal sheet is turned over, so the surface of the metal sheet with the small recesses therein faces up, and an etching-resistant layer is formed on the surface of the metal sheet which faces up. Then, the regions corresponding to the large openings on the surface of the metal sheet which faces down is etched, to form large recesses, while keeping the metal sheet substantially horizontal, until the large recesses are reached to the resistant layer. Thus, each aperture is formed. Thereafter, the resist film and the resistant layer are removed. Thus, a shadow mask is manufactured which has a number of apertures regularly arranged therein, so the areas of the both openings of each aperture on the two surfaces of the shadow mask are different.

7 Claims, 14 Drawing Figures

METHOD FOR MANUFACTURING A SHADOW MASK

BACKGROUND OF THE INVENTION

The present invention relates to a method for manufacturing a shadow mask of a color cathode-ray tube and, more specifically, to an etching process for manufacturing a shadow mask.

A shadow mask of a color cathode-ray tube having a number of regularly arranged apertures, is disposed in the tube, and faces a phosphor layer formed on an inner surface of face plate. With use of this shadow mask, electron beams emitted from an electron gun are accurately landed through the apertures on their corresponding phosphor stripes or dots of the phosphor layer which emits different colors, i.e., red, green and blue. Thus, the shadow mask has the so-called color discriminating function, constituting an essential member of the color cathode-ray tube.

Each of the apertures of the shadow mask is formed so as to be spread like a flared skirt across the thickness of the shadow mask, that is, in the direction perpendicular to the surface of the shadow mask. The diameter or opening area of the aperture on the surface opposed to the electron gun is smaller than that of the opening of the aperture facing the phosphor layer. The small-diameter opening of the aperture will hereafter be referred to as a small aperture opening; the large-diameter opening, as a large aperture opening. The aperture having such a sophisticated configuration is conventionally formed by etching. In the etching process, if the diameters of the aperture openings are reduced, it becomes more difficult in proportion to ensure the accuracy of the diameters. In particular, it is very difficult to form an aperture with a diameter smaller than the thickness of the shadow mask. A conventional etching process for forming an aperture with a diameter smaller than the thickness of a shadow mask is disclosed in Japanese patent publication No. 26345/82, which corresponds to U.S. Pat. Ser. No. 487,663 filed on July 11, 1974. In the etching process disclosed in this application showing in FIGS. 1 and 2, resist films having an etching-resistant property are selectively deposited on the surfaces of a metal plate or sheet 1, so the regions corresponding to large and small aperture openings Da and Db to be etched are exposed and the other regions are coated with resist films 2A and 2B. The etched plate or sheet 1 is delivered to zone A of FIG. 1 with its surface for the large aperture opening Da facing downward. In zone A, the metal plate 1 is etched to predetermined depths from both sides, as a first etching step, so a portion of a predetermined thickness H is left unetched. Thereafter, the metal plate 1 is washed with water in zone B and dried in zone C. Then, a material resistant to etching solution, such as asphalt, paraffin or polymerized plastics, is sprayed on the metal plate surface on the side of the small aperture opening Db in zone D and dried in zone E to form a resistant layer 3, as shown in FIG. 2. Thereafter, in zone F, as a second etching step, the metal plate 1 is etched only on the surface with the large aperture opening Da until the aperture reaches the resistant layer 3 filling the small aperture opening Db. After the etching is accomplished, the metal plate 1 is delivered to subsequent steps for washing with water, removal of the resistant layer and the resist film, etc. According to the method stated in this application, the apertures may be bored through the shadow mask with use of the opening diameter equal to about 40 percent of the metal plate thickness.

However, the etching process disclosed in the aforesaid application involves the following problems. In general, the resist films 2A and 2B, covering regions other than the regions to be formed with aperture openings, will be lowered in etching resistance and undergo distortion if they are etched with the small aperture opening Db up and the large aperture opening Da down, washed with water, and dried after the normal exposure, developed, dried and burnt. During the second etching step for the large opening side, therefore, the bond strength between the resist film 2A and the metal plate 1 is lowered so much that excessive side etching is caused, resulting in variations in the aperture size. Moreover, distortion of the resist film portion caused by excessive side etching leads to an uneven aperture shape and a lower quality shadow mask.

After the first etching step is accomplished, the small aperture opening Db is filled with the resistant material. The most difficult point of this filling operation lies in that the part of the resist film 2B on the small opening side is formed into an overhanging portion **2*c* by a side-etching effect produced in the first etching step. The overhanging portion 2*c* would constitute a substantial hindrance to filling the aperture recess with the resistant material. In filling the aperture recess with the resistant material by the immersion or spraying method, some of the air around the overhanging portion 2*c*** is liable to remain in the form of air bubbles, failing to be released into the outside air. Thus, the region involving the air bubbles can be etched faster than the filled region in the second etching step, so that the aperture shape is liable to errors.

Further, if the metal plate is etched in a manner such that the surface for the small aperture opening, which determines the aperture size at the time of the first etching step, faces upward, the etching solution will be collected on the metal plate, preventing the progress of the etching operation for forming aperture recesses of a uniform size for all small aperture openings. Thus, the aperture size would be subject to variations.

SUMMARY OF THE INVENTION

The object of the present invention is to provide a method for manufacturing a shadow mask, capable of accurately boring apertures with diameters smaller than the thickness of the shadow mask through the shadow mask over the whole surface thereof.

According to the invention, there is provided a method for manufacturing a shadow mask having a number of apertures regularly arranged therein, the areas of small and large openings of each aperture on the both surfaces thereof being different, comprising the steps of:

coating both surfaces of a metal sheet with resist films except first and second regions corresponding to the small and large openings;

etching first regions with the first surface of the metal sheet down to form first recesses, said etching step being carried out by spraying an etching solution on the first surface of the metal sheet such that the other opposite second surface of the metal sheet is protected from the etching solution while keeping the metal sheet substantially horizontal;

washing the first surface of the metal sheet with the first recesses therein while protecting the opposite second surface of the metal sheet;

removing the resist film from the first surface of the metal sheet with the first recesses therein by means of a resist film removing solution, while preventing the resist film removing solution from attaching on the opposite second surface of the metal sheet;

washing the metal sheet removed of the resist film while protecting the opposite second surface of the metal sheet;

turning over the metal sheet, so the first surface of the metal sheet with the first recesses therein faces up;

forming an etching-resistant layer on the first surface of the metal sheet with the first recesses therein;

etching second regions with the opposite second surface of the metal sheet down to form second recesses, said etching step being carried out by spraying the etching solution, while keeping the metal sheet substantially horizontal, on the opposite second surface of the metal sheet to etch the second regions until the first recesses reach the resistant layer filling the first recesses and are communicated with the first recesses, thereby forming each of the apertures;

washing the both surfaces of the metal sheet;

removing the remaining resist film and the remaining resistant layer;

washing the both surface of the metal sheet; and drying the metal sheet.

DETAILED DESCRIPTION OF THE PREFERRED EMBODIMENTS

Figure 1:
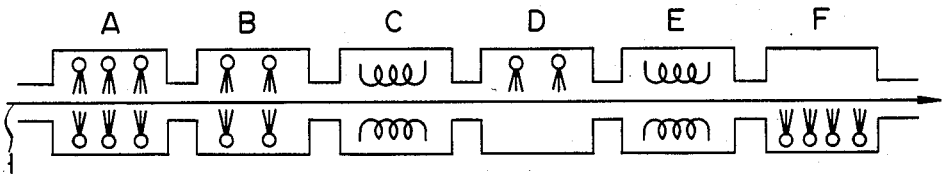
FIG. 1 (PRIOR ART)
FIG. 1 is a diagram schematically showing the steps for forming apertures in a prior art shadow mask.
Figure 2:
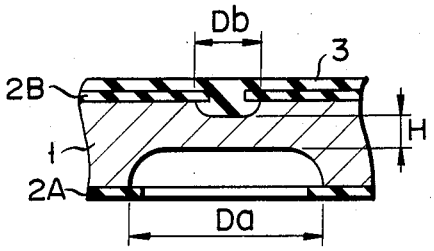
FIG. 2 (PRIOR ART)
FIG. 2 is a sectional view of a metal plate formed in an intermediate step shown in FIG. 1.
Figure 3:
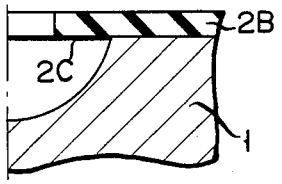
FIG. 3 (PRIOR ART)
FIG. 3 is a partial, enlarged sectional view of the metal plate shown in FIG. 2 for illustrating side etching caused in a recess.
Figure 4A:
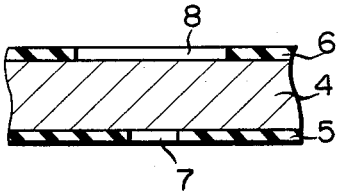
FIGS. 4A to 4F are schematic sectional views of a metal plate showing how recesses are bored in the metal plate in several steps of a method for forming apertures in a shadow mask according to one embodiment of the present invention.
Figure 4D:
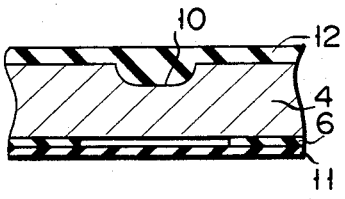
Figure 4B:
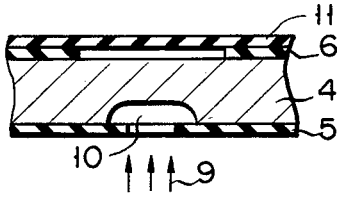
Figure 4E:
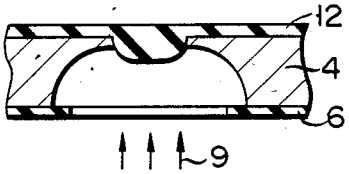
Figure 4C:
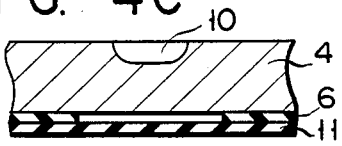
Figure 4F:
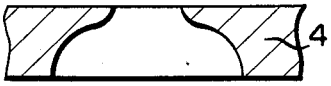
Figure 5:
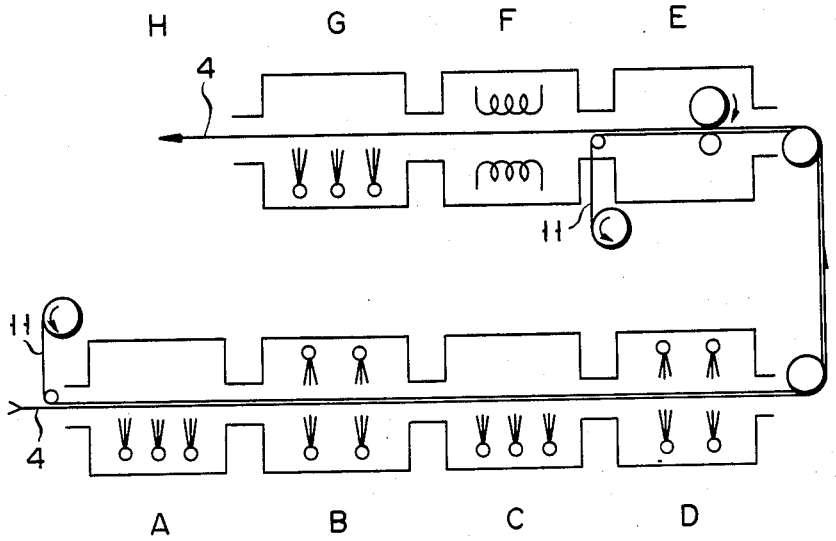
FIG. 5 is a schedule diagram schematically showing the steps of the method according to one embodiment.

Referring now to FIGS. 4 and 5, a method for manufacturing a shadow mask of a color cathode-ray tube according to one embodiment of the present invention will be described in detail.

An aluminum-killed, low-carbon steel plate or sheet having smooth surfaces and a thickness of 0.13 mm is prepared as a material for the shadow mask. A photosensitizer formed of alcari caseinate and ammonium bichromate is applied to both sides of the low-carbon steel plate and is dried to form resist films 5 and 6 of about 5-micron thickness. Then, a negative mask pattern glass bearing circular images with a diameter of about 80 microns is stuck to first surface of a thin metal plate 4, while another negative mask pattern glass bearing circular image with a diameter of about 150 microns is stuck to the opposite second surface so as to be aligned with the first negative mask pattern glass on the first surface for a concentric arrangement of the two circular images. The negative mask films are exposed to light for 30 seconds by using a 5-kW mercury lamp at a distance of one meter. After the negative mask pattern glass are removed, portions of the resist films 5 and 6 are dissolved and removed by spraying water of 40° C. thereon under a spraying pressure of 1 kg/cm$^2$ to expose the metal surfaces 7 and 8 which correspond to regions for small and large aperture openings, respectively, as shown in FIG. 4A. Thereafter, the metal plate 4 with the resist films 5 and 6 thereon is dried in an atmosphere of 150° C. for about 2 minutes and burned in an atmosphere of 200° C. for about 2 minutes to improve the etching resistance of the resist films 5 and 6 and the bonding strength thereof on the metal plate 4.

Subsequently, a protective film 11 of polyethylene, polypropylene or polyvinyl chloride is adhered to the upper surface of the metal plate 4 in which the large aperture openings are to be formed, as shown in FIG. 4B. In zone A of FIG. 5, an etching solution 9 is sprayed on the lower surface of the metal plate 4 in which the small aperture openings are to be formed, so the metal plate 4 is etched, as a first etching step, until a recess 10 is formed therein. In zone B of FIG. 5, the metal plate 4 is washed with water. The etching solution used is a ferric chloride solution with a specific gravity of 1.45 to 1.49. The solution is kept at 50° to 70° C. and sprayed for etching under a spraying pressure of 1 to 2 kg/cm$^2$. Then, in zone C of FIG. 5, a 15 percent sodium hydroxide solution of 60° C. is sprayed on the metal surface, on which the small aperture openings are formed, to remove the remaining resist film 5, while the protective film 11 is kept on the metal surface on which the large aperture openings are to be formed. In zone D of FIG. 5, the metal plate 4 is washed with water. Then, the metal plate 4 is turned over, so the recesses 10 formed in the first etching step is face up, as shown in FIG. 4C. In zone E of FIG. 5, the metal surface with the recesses 10 therein is coated with a water-soluble etching-resistant material such as polyvinyl alcohol, disperse epoxy resin, or alkyd resin by means of a roller. Thus, the recesses 10 on the small opening side are filled up. In zone F of FIG. 5, the etching-resistant material is dried to form a resistant layer 12, as shown in FIG. 4D. Some kinds of water-soluble etching-resistant materials cannot be quickly replaced with water in the recesses 10 when the metal plate 4 is wet. When using such resistant material, it should be applied after the metal plate 4, removed of the resist film 5 on the small opening side and washed with water, is dried. The suitable coat thickness of the etching-resistant material on the surface of the metal plate 4, except on the recesses 10, ranges from 5 to 10 microns. The resistant material may be applied by the knife-coating, spraying, dipping and bar-coater methods, as well as by the roller-coating method. When using a water-insoluble resistant material, such as paraffin, petroleum pitch, lacquer, etc., the resistant layer 12 should be formed by drying the metal plate 4 after it is removed of the resist film 5 on the small-opening side and washed with water.

After the resistant layer 12 is formed, the protective film 11 on the metal surface for the large aperture openings are stripped off, and the large aperture openings are formed in zone G of FIG. 5. That is, the etching solution 9 of ferric chloride is sprayed only on the downward facing metal surface, as a second etching step, so that recesses reaching the resistant layer 12 are formed corresponding to the large aperture openings, as shown in FIG. 4E. Thereafter, in zone H of FIG. 5, the resistant layer 12 and the resist film 6 are removed, as shown in FIG. 4F. Thus, the steps for forming the aperture are finished.

The etching depths for the first and second etching steps for the small and large aperture opening sides depend on the aperture size and metal plate thickness of the shadow mask. In any case, the etching amount for the second etching step for the large opening side is greater than that for the first etching step for the small opening side. In order to obtain the optimum etching amount for the two etching steps, the ratio between the lengths of etching chambers for the first and second etching steps may be changed, or the specific gravity and/or temperature of the etching solution or the spraying pressure may be adjusted suitably.

The shadow mask manufactured in this manner is high in quality and no defects, enjoying an improved aperture shape and error-free aperture diameter smaller than the metal plate thickness. In the embodiment described above, if the method of resistant material coating does not allow the resistant material to stick to the underside of the metal plate, the protective film may be stripped off before the resistant material coating step.

Figure 6A:
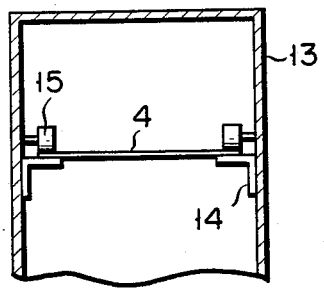
FIGS. 6A and 6B are a partial, sectional view and a broken away, perspective view, respectively, schematically showing an etching chamber used in forming an aperture opening.
Figure 6B:
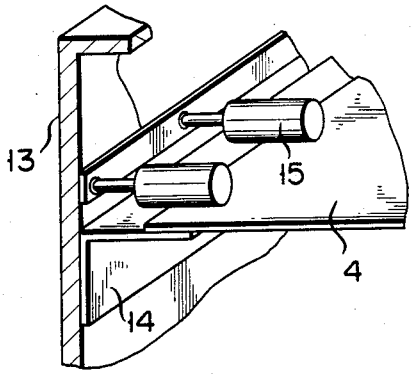
Figure 7:
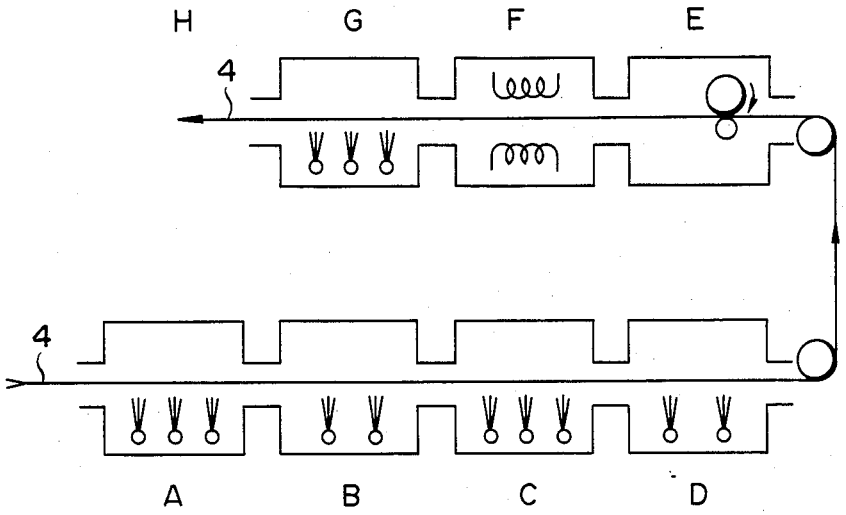
FIGS. 7 and 8 are schedule diagrams schematically showing several steps of a method for forming apertures in a shadow mask according to another embodiment of the invention.

Referring now to FIGS. 6A, 6B and 7, a modified embodiment of the invention will be described. The sequence of steps from the resist film coating step to the burning step of this modified embodiment is the same as that of the foregoing embodiment, so a description of those steps is omitted.

After the burning step, the lower surface of the metal plate 4 to be formed with the small aperture opening is etched in zone A of FIG. 7. In order to prevent the etching solution from attaching to the metal surface to be formed with the large aperture openings, in this modified embodiment, an etching chamber 13 is provided with screen plates 14 for preventing the etching solution from scattering from the side walls of the chamber 13, which are disposed in the traveling path of the metal plate 4, as shown in FIGS. 6A and 6B. In the etching chamber 13, the metal plate 4 is etched until recesses of a predetermined depth corresponding to the small aperture openings are formed. The chamber with the screen plates may have various structures, and the one shown in FIGS. 6A and 6B is given only as an example. In the chamber 13 of FIGS. 6A and 6B, the metal plate 4 is pressed down by rubber rollers 15, so it will not lift off the screen plates 14 by the upward spraying pressure of the etching solution. After the end of the etching step, the etching solution attaching to the metal surface on the small opening side is washed away in a washing chamber with screen plates similar to those of the etching chamber 13 in zone B of FIG. 7. Then, in zone C of FIG. 7, the resist film on the small opening side is removed by means of a sodium hydroxide solution, as in the first embodiment, in a resist film removing chamber with screen plates similar to those of the etching chamber 13. Thereafter, in zone D of FIG. 7, the metal plate 4 is washed with water and dried. The metal plate 4 need not always be dried here depending on the type of etching-resistant material to be applied in the following step. Then the metal plate 4 is turned over, so the metal surface with the recesses therein is face up. In zone E of FIG. 7, as in the case of the first embodiment, the etching-resistant material is applied only to the upward surface of the metal plate 4, on which the small aperture openings are formed, in a resistant material coating chamber with screen plates similar to those of the etching chamber 13. Thereafter, in zone F of FIG. 7, the metal plate 4 is dried to form a resistant layer thereon. Then, in zone G of FIG. 7, the etching solution is sprayed upward only on the metal surface for the large aperture openings for second etching in an etching chamber without screen plates. As a result, recesses corresponding to the large aperture openings reach the resistant layer, thereby completing shadow mask aperture of a desired size. Then, in zone H of FIG. 7, the resistant layer and the resist film are removed. Thus, the aperture forming process is accomplished.

If the resistant material can suitably be applied without attaching to the underside of the metal plate, the resistant material coating chamber need not have the screen plates.

Figure 8:
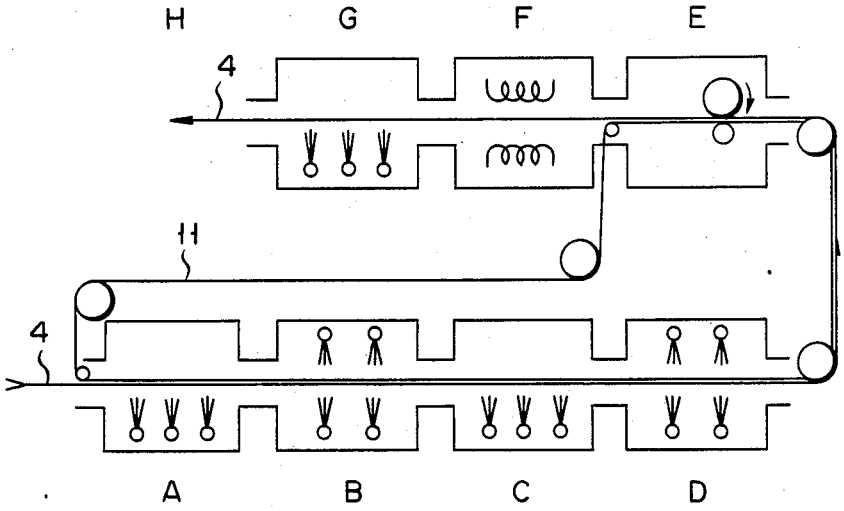

Referring now to FIG. 8, another modified embodiment of the invention will be described. The sequence of steps from the resist film coating step to the burning step of this second modified embodiment is the same as that of the first embodiment, so the description of those steps is omitted.

After the burning step, the lower surface of the metal plate 4 to be formed with the small aperture opening is etched in zone A of FIG. 8. In order to prevent the etching solution from attaching to the metal surface to be formed with the large aperture openings, in this second modified embodiment, a magnetic sheet 11 is contacted on the surface of the metal plate 4 on which the large aperture openings are formed. The metal plate 4 contacted with the magnetic sheet 11 is etched on the lower surface side to form the small aperture opening in zone A of FIG. 8.

The magnetic sheet 11 should preferably be formed of a rubber sheet or a flexible plastic sheet coated or impregnated with a magnetic material. As shown in FIG. 8, the magnetic sheet 11 is looped and can be transferred for continuous use. After the etching step, the metal plate 4 with the magnetic sheet thereon is washed with water in a washing chamber so that the etching solution attaching to the metal surface with the small aperture openings therein is washed away in zone B of FIG. 8. Then, in zone C of FIG. 8, only the resist film on the small opening side is removed by means of a sodium hydroxide solution, as in the first embodiment, in the resist film removing chamber. Thereafter, in zone D of FIG. 8, the metal plate 4 is washed with water and dried. The metal plate 4 need not always be dried here depending on the kind of the etching-resistant material to be applied in the following step. Then, the metal plate 4 is turned over, so the metal surface with the recesses therein is face up. In zone E of FIG. 8, as in the case of the first embodiment, the resistant layer is formed only on the small opening side, while the magnetic sheet 11 is kept on the surface to be formed with the large aperture opening. In zone F of FIG. 8, the metal plate 4 is dried. Thereafter, the magnetic sheet 11 is stripped off from the large opening side of the metal plate 4 and is returned to the first etching step by circulation. The steps to follow this are the same as those of the first embodiment.

Although the resistant layer is formed on the small opening side in the embodiments described above, it is to be understood that the resistant layer may alternatively be formed on the large opening side.

According to the present invention, as described above, the first and second etching operations are always performed from the underside of the metal plate, and a high-quality shadow mask may be obtained which is improved in aperture shape and free from defective apertures and has a uniform aperture diameter smaller than the metal plate thickness.

What is claimed is:

1. A method for manufacturing a shadow mask on a metal sheet which has a first surface and an opposite second surface, said shadow mask having a number of small and large diameter apertures regularly arranged therein, the areas of the small and large diameter apertures being different, comprising the steps of:

coating portions of both surfaces of the metal sheet with resist films, all of both surfaces being coated except first and second regions which are located at the location where the small and large diameter openings are desired to be located, said first region being on said first surface of the metal sheet, and said second region being on said second surface thereof;

etching first regions with the first surface of the metal sheet facing downward to form first recesses, said etching step being carried out by spraying an etching solution upward onto the first surface of the metal sheet such that second surface of the metal sheet is protected from the etching solution while keeping the metal sheet in a substantially horizontal;

washing the first surface of the metal sheet with the first recesses therein while protecting the second surface of the metal sheet, thereby removing substantially all of the etching solution from the first surface;

removing the resist film from the first surface of the metal sheet with the first recesses therein by means of a resist film removing solution, while preventing the resist film removing solution from coming in contact with the second surface of the metal sheet;

washing the first surface of the metal sheet removed of the resist film, while protecting the second surface of the metal sheet;

turning over the metal sheet, so the first surface of the metal sheet with the first recesses therein faces upward;

form an etching-resistant layer on the first surface of the metal sheet with the first recesses therein;

etching second regions on the second surface with the second surface of the metal sheet facing downward, to form second recesses, said etching second step being carried out by spraying the etching solution upward, while keeping the metal sheet in a substantially horizontal position, onto the second surface of the metal sheet to etch the second regions until the first recesses reach the resistant layer filling the first recesses and are communicated with the first recesses, thereby forming each of the apertures;

washing the both surfaces of the metal sheet;

removing the remaining resist film and the remaining resistant layer;

washing the both surfaces of the metal sheet; and drying the metal sheet.

2. The method according to claim 1, wherein the second surface of the metal sheet which faces up is coated with an organic synthetic film to be protected against the attaching of the etching solution after both surfaces of the metal sheet are coated with the resist films, and said etching solution is thereafter sprayed on the first surface of the metal sheet to form the first recesses therein.

3. The method according to claim 2, wherein said protective film on the second surface of the metal sheet is removed, and the second surface which faces down is etched to form the second recesses after the etching-resistant layer is formed on the first surface.

4. The method according to claim 1, wherein the second surface of said metal sheet is coated with a magnetic sheet to be protected against the attaching of the etching solution after both surfaces of the metal sheet are coated with the resist films, and the etching solution is thereafter sprayed on the first surface of the metal sheet to form said first recesses therein.

5. The method according to claim 4, wherein said magnetic sheet is looped and is magnetically contacted to the metal sheet repeatedly which is continuously fed.

6. The method according to claim 1, wherein said etching step for forming said first recesses in the first surface of the metal sheet is executed in a chamber having screen plates for preventing the etching solution sprayed on said first surface from attaching on the second surface of the metal sheet which faces up.

7. An apparatus for manufacturing a shadow mask on a metal sheet which has a first surface and an opposite second surface, said shadow mask having a number of small and large diameter apertures regularly arranged therein, where areas of the small and large diameter apertures are different, comprising:

means for coating portions of both surfaces of the metal sheet with resist films, all of both surfaces being coated except first and second regions which are located at the locations where the small and large diameter openings are desired to be located, said first region being on the first surface of the metal sheet, and said second region being on the second surface thereof;

means for protecting the second surface of said metal sheet;

means for etching first regions with the first surface of the metal sheet facing downward to form first recesses by spraying an etching solution upward onto the first surface of the metal sheet, while the second surface of the metal sheet is protected from the etching solution by said protecting means, and while keeping the metal sheet in a substantially horizontal position;

means for washing the first surface of the metal sheet with the first recesses therein, while the second surface of the metal sheet is protected by said protecting means, thereby removing substantially all of the etching solution from the first surface;

means for removing the resist film from the first surface of the metal sheet which has the first recesses therein using a resist film removing solution, while the resist film removing solution is prevented from coming in contact with the second surface of the metal sheet by said protecting means;

means for washing the first surface of the metal sheet removed of the resist film, while the second surface of the metal sheet is protected by said protecting means;

means for turning over the metal sheet, so the first surface of the metal sheet with the first recesses therein faces upward;

means for forming an etching-resistant layer on the first surface of the metal sheet which has the first recesses therein;

means for etching second regions on the second surface, with the second surface of the metal sheet facing downward to form second recesses, by spraying the etching solution upward onto the second surface of the metal sheet to etch the second regions until the first recesses reach the etching-resistant layer fill the first recesses and are communicated with the first recesses, thereby forming each of the apertures;

means for washing the both surfaces of the metal sheet;

means for removing the remaining resist film and the remaining resistant layer; and means for washing the both surfaces of the metal sheet.

* * * * *